US007131183B2

(12) United States Patent
Burchett et al.

(10) Patent No.: US 7,131,183 B2
(45) Date of Patent: Nov. 7, 2006

(54) SCREW IN HIGH VOLTAGE HOUSING TERMINAL FOR IGNITION COIL

(75) Inventors: Rick S. Burchett, Ypsilanti, MI (US); William D. Walker, Saline, MI (US)

(73) Assignee: Ford Motor Company, Dearborn, MI (US)

( * ) Notice: Subject to any disclaimer, the term of this patent is extended or adjusted under 35 U.S.C. 154(b) by 213 days.

(21) Appl. No.: 10/832,088

(22) Filed: Apr. 26, 2004

(65) Prior Publication Data

US 2005/0237142 A1 Oct. 27, 2005

(51) Int. Cl.
*H01F 7/127* (2006.01)

(52) U.S. Cl. ..... 29/602.1; 29/606; 29/33 L; 29/525.11; 123/621; 336/96; 264/272.11

(58) Field of Classification Search ..... 29/602.1, 29/606, 842, 855, 33 L, 33 M, 525.11, 525.12; 336/90, 96, 192, 210; 123/621; 264/249, 264/272.11, 272.19
See application file for complete search history.

(56) References Cited

U.S. PATENT DOCUMENTS

| | | | | |
|---|---|---|---|---|
| 1,474,597 | A | 11/1923 | Kent | |
| 1,499,931 | A | 7/1924 | Jacobson | |
| 1,931,619 | A | 10/1933 | Norviel | |
| 2,081,979 | A | 6/1937 | Bentley | |
| 2,377,353 | A | 6/1945 | Messerschmidt | |
| 2,904,763 | A | 9/1959 | Harruff | |
| 3,803,793 | A * | 4/1974 | Dahl | 29/525.11 X |
| 4,459,967 | A | 7/1984 | Hayashi | |
| 4,514,712 | A * | 4/1985 | McDougal | 336/96 |
| 4,528,971 | A | 7/1985 | Hüttinger et al. | |
| 5,187,862 | A | 2/1993 | Ohsumi | |
| 5,959,407 | A | 9/1999 | Ito et al. | |
| 6,404,142 | B1 | 6/2002 | Miyata et al. | |

FOREIGN PATENT DOCUMENTS

| | | | |
|---|---|---|---|
| JP | 4-32243 | * 2/1992 | 29/841 |
| JP | 61-251013 | 11/1996 | |
| JP | 9-148155 | 6/1997 | |
| JP | 8-8125 | 3/2000 | |

OTHER PUBLICATIONS

English Abstract for JP 9-148155.
English Abstract for JP 61-251013.

* cited by examiner

*Primary Examiner*—A. Dexter Tugbang
(74) *Attorney, Agent, or Firm*—Mark Sparschu; MacMillan Sobanski & Todd

(57) ABSTRACT

An ignition coil and a method for its manufacturer are provided, the ignition coil including a housing, a primary winding and a secondary winding disposed in the housing, and a terminal including a connection portion in electrical communication with the secondary winding and a threaded portion engaging the housing. The threaded portion of the terminal may include a self-tapping threaded portion. Furthermore, the terminal may include a first body portion having a first threaded portion and a first median diameter and a second body portion having a second threaded portion and a second median diameter, where the second median diameter is greater than the first median diameter. The terminal may also include a shoulder portion having a diameter greater than the second median diameter and a third body portion having a third median diameter greater than the second median diameter.

6 Claims, 3 Drawing Sheets

SCREW IN HIGH VOLTAGE HOUSING TERMINAL FOR IGNITION COIL

BACKGROUND

The present invention relates generally to ignition coils for an internal combustion engine. More specifically, the invention relates to a terminal for an ignition coil, and the connection between the terminal and the ignition coil housing.

Ignition coils typically contain a core assembly constructed of steel lamination stacks upon which primary and secondary windings of the assembly are mounted. The primary and secondary windings are typically comprised of copper wire and are typically each wound around a respective bobbin. The core assembly, the primary and secondary windings, and their respective bobbins are all disposed within an ignition coil housing. A terminal is typically coupled with the housing, as will be discussed in further detail below, in order to form an electrical connection with the secondary winding. An encapsulate material, such as a thermosetting resin, may be poured into the housing in order to secure the above-described assembly within the housing.

Currently, terminals are secured to ignition coils by various types of connections. In one such connection, the terminal is insert molded into the housing. More specifically, the terminal is inserted into a mold, and the housing is formed around the terminal through various methods such as injection molding. However, insert molding includes complexities such as tooling the mold and properly inserting the terminal into the mold. Additionally, the terminal may interfere with other desired features of the housing, such as various other insert molded components.

In another connection between the terminal and the ignition coil, the terminal is inserted through a bore in the housing and into electrical connection with a metal bracket that is in turn in electrical connection with the secondary winding. However, the terminal and the housing may not effectively form a seal in order to prevent the encapsulate material from leaking through the housing bore and about the terminal.

In yet another connection between the terminal and the ignition coil, the housing includes a collar having an outer surface engaged with an opening in the housing. The collar also includes an inner surface having internal threads for threaded connection with a threaded portion of the terminal. However, this design requires additional manufacturing steps and additional components, such as the threaded insert.

Therefore, it is desirous to provide an ignition coil that prevents encapsulate from leaking out of ignition coil housing and that minimizes manufacturing complexity.

SUMMARY

In overcoming the disadvantages and drawbacks of the known technology, the current invention provides a system and a method that improve the connection between a terminal and a housing in an ignition coil.

One object of the current invention is to provide an ignition coil having a primary winding and a secondary winding disposed within a housing. A terminal is in electrical connection with the secondary winding via a connection portion and engages the housing via a threaded portion. The housing may further include a terminal receiving portion defining a bore and cooperating with the terminal in order to form a fluid-tight seal.

In another object of the present invention, the terminal includes a self-tapping threaded portion. In order to improve the engagement between the self-tapping threaded portion of the terminal and the housing, the housing may be comprised of a plastic material.

In another aspect of the current invention, the terminal includes a first body portion having a first threaded portion and a first median diameter and a second body portion having a second threaded portion and a second median diameter, wherein the second median diameter is greater than the first median diameter. The first body portion of the terminal may be generally conical in shape and the second body portion of the terminal may be generally cylindrical in shape. Additionally, the connector portion of the terminal may be generally cylindrical in shape.

In another aspect of the present invention, the terminal includes a shoulder portion having a diameter greater than the second median diameter of the second body portion. Additionally, the terminal may include a third body portion, located between the second body portion and the shoulder portion, having a third median diameter that is greater than the second median diameter. The third body portion of the terminal may be generally conical in shape. Finally, the terminal may also include a torque transfer portion having a slotted portion or a polygon-shaped portion for rotating the terminal during installation.

Another object of the present invention is to provide a method of manufacturing an ignition coil. According to one embodiment, the method includes the steps of inserting a primary winding and a secondary winding within the housing, inserting a terminal having a terminal threaded portion into a terminal receiving portion of the housing, and forming a housing threaded portion within the terminal receiving portion of the housing. The step of inserting the terminal into the terminal receiving portion of the housing and the step of forming the housing threaded portion within the terminal receiving portion of the housing may occur substantially simultaneously.

In another aspect, the method of manufacturing the ignition coil may further include the step of inserting an encapsulate material into the housing and forming a fluid-tight seal between the terminal and the terminal receiving portion of the housing. In yet another aspect, the method of manufacturing the ignition coil may further include the step of applying a rotational torque to a torque transfer member of the terminal in order to rotate the terminal about an axis to connect the terminal with the housing. Furthermore, the step of applying a rotational torque to the torque transfer member of the terminal and the step of forming a housing threaded portion within the terminal receiving portion of the housing occur substantially simultaneously.

DETAILED DESCRIPTION

Figure 1:
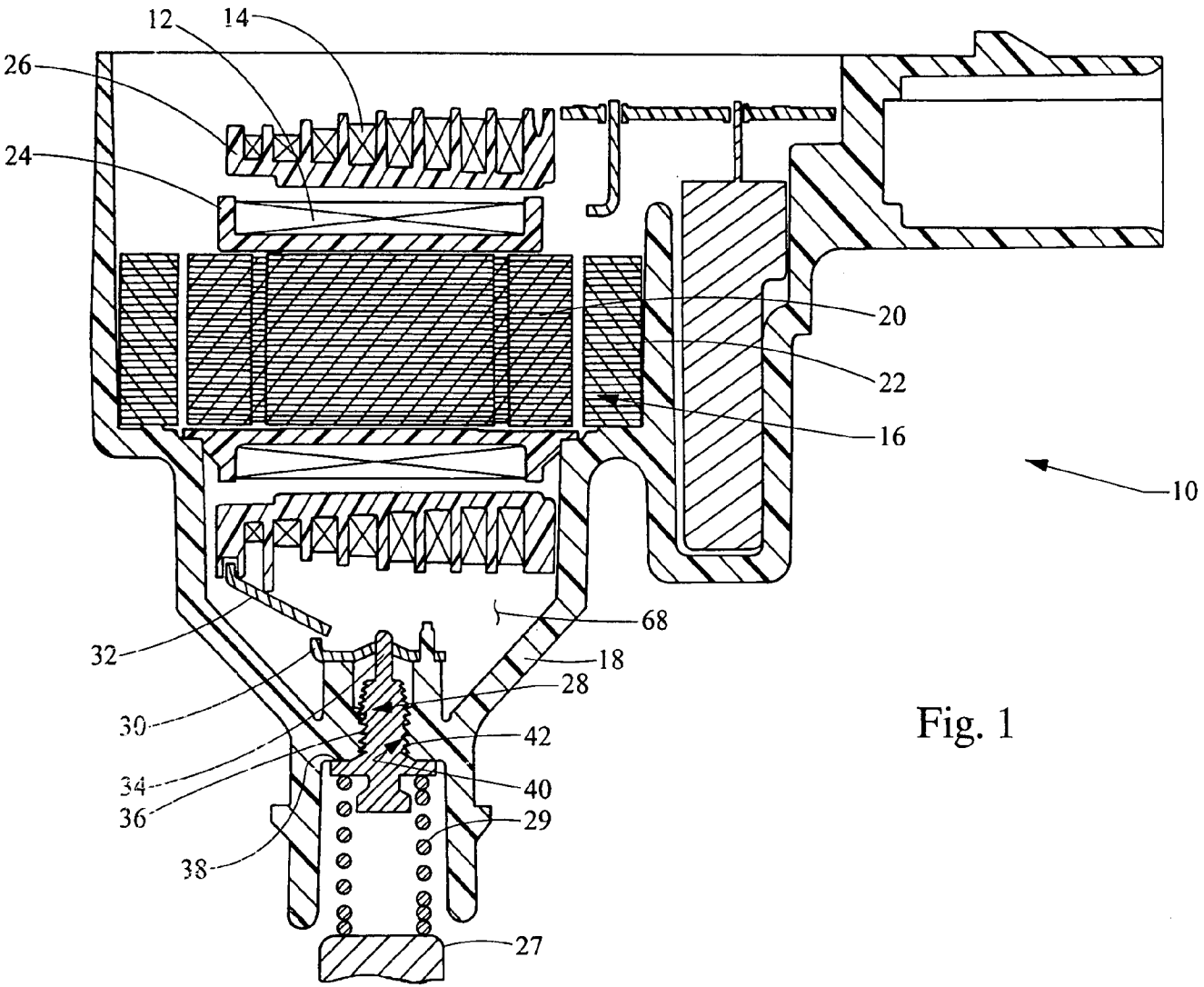
FIG. 1 is a cross sectional view of an ignition coil including a terminal and embodying the principles of the present invention.

Referring now to the drawings, FIG. 1 shows an ignition coil 10 having a primary winding 12, a secondary winding 14, and a core assembly 16 disposed within a housing 18. The core assembly 16 includes an inner core 20 and an outer core 22 each comprising lamination stacks. The lamination stacks are preferably constructed of steel, but it will be recognized that any appropriate metal may be used. Particularly, appropriate metals preferably have a high permeability and a low core loss. Additionally, the core assembly 16 may be constructed in solid or other non-laminate forms.

The primary winding 12 is wrapped around a primary bobbin 24 and the secondary winding 14 is wrapped around a secondary bobbin 26. The primary bobbin 24 and the secondary bobbin 26 serve as dielectric barriers separating the respective windings 12, 14 from each other and from the core assembly 16. The secondary winding 14 is in electrical communication with a spark plug 27 via a terminal 28. More specifically, the terminal 28 preferably contacts a bracket 30 that is in connection with the secondary winding 14 via a connector wire 32. The bracket 30 may include an opening (not shown) in order to form a press fit connection with the terminal 28. In order to connect with bracket 30, the terminal 28 may include a connector portion 34 having a reduced diameter and a generally cylindrical shape. However, the connector portion 34 is illustrated as being pin-like, but may be any appropriate shape or size. The terminal 28 is preferably connected to the spark plug 27 via an adjustable-length metal connector, such as a spring 29.

Alternatively, the terminal 28 may include a connector portion 34 that is an opening (not shown). In this design, the ignition coil 10 is in direct contact with the connector wire 32 of the secondary winding 14. More specifically, a portion of the connector wire 32 is angled such as to fit within the opening of the terminal 28.

During operation of the ignition coil 10, a current having an input voltage is supplied to the primary winding 24 from a battery (not shown), and this causes a magnetic field to form around the core assembly 16. The current is then selectively disrupted, which in turn creates a spark to be produced by the spark plug 27. More specifically, when the current is disrupted the magnetic field undergoes a rapid change and induces a current having an output voltage in the secondary winding 14. The secondary winding 14 preferably includes a much higher number of windings than the primary winding 12 in order to cause the output voltage induced in the secondary winding 14 to be much higher than the input voltage supplied from the battery. For example, the input voltage may be approximately 350 Volts, and the output voltage may be approximately 35,000 Volts.

As shown in FIG. 1, the terminal 28 preferably engages the housing 18 via a threaded engagement with a terminal receiving portion of the housing, such as a bore 36. The terminal 28 preferably directly engages the housing 18 via the bore 36 in order for form a seal 38 therebetween. More specifically, the terminal 28 preferably includes a threaded portion 40 for engagement with internal threads 42 defined by the bore 36.

Figure 2:
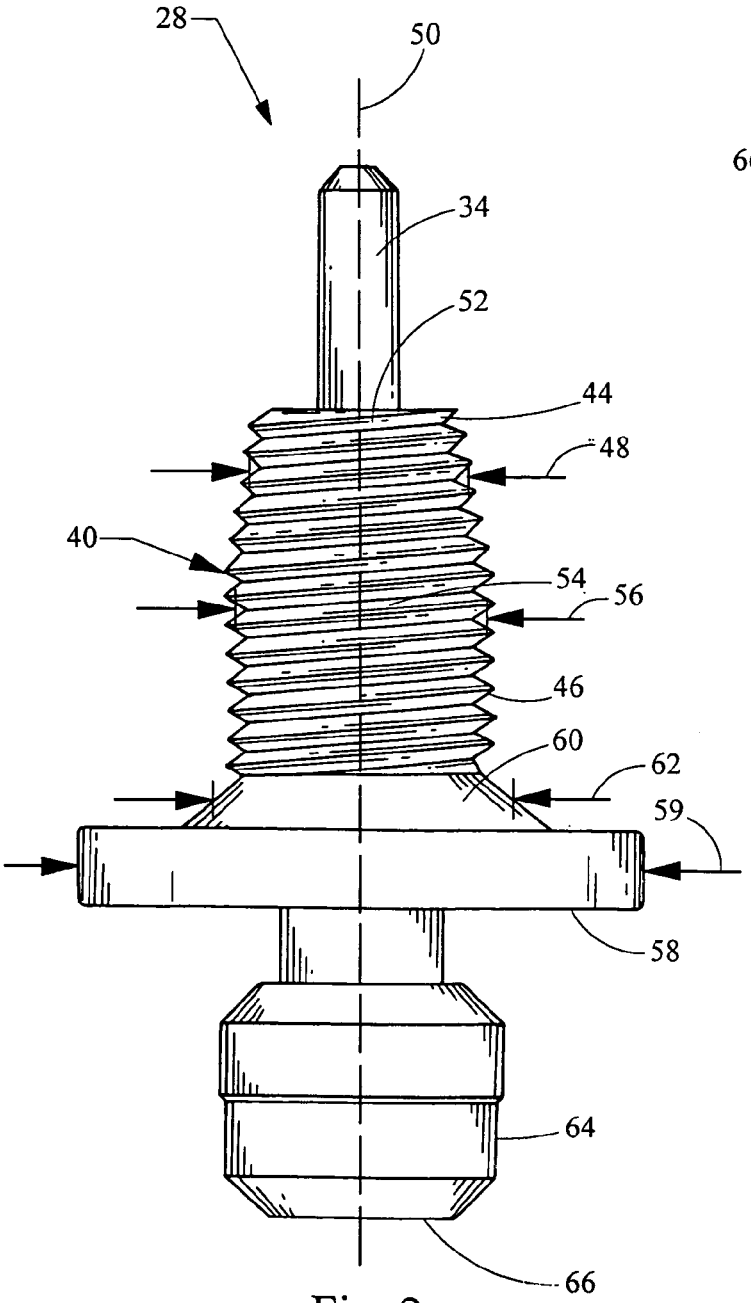
FIG. 2 close-up view of the terminal shown in FIG. 1.
Figure 3A:
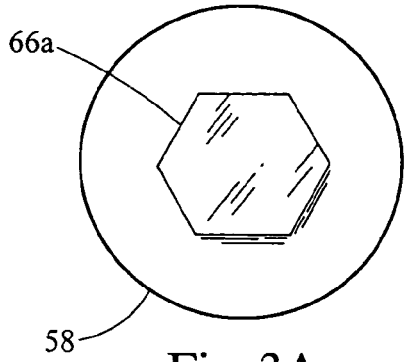
FIGS. 3A–3C are three different embodiments in side view similar to the terminal shown in FIG. 2.
Figure 3B:
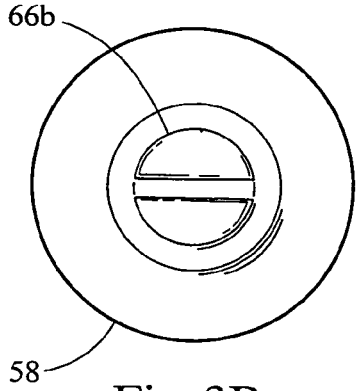
Figure 3C:
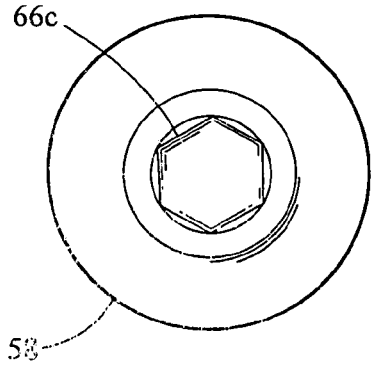

The internal threads 42 of the housing 18 are preferably formed by self-tapping threads of the terminal 28. The self-tapping threads may be thread-forming threads, where the material of the housing 18 is deformed in order to form the internal threads 42; or may be thread-cutting threads, where the material of the housing 18 is cut in order to form the internal threads 42. Accordingly, the self-tapping threads will have an appropriate configuration to achieve the above. One such configuration, shown in FIG. 2, includes starter threads 44 and engagement threads 46. The starter threads 44 initiate the forming of the internal threads 42 by scoring or deforming the bore 36. The starter threads 44 preferably have a starter thread median diameter 48 that progressively increases in a direction away from the connector portion 34 along a central axis 50 of the terminal 28. One such progressively increasing starter thread median diameter 48 is shown in FIG. 2, where the terminal 28 includes a tapered body portion 52 having a generally conical shape such that the starter threads 44 progressively deepen the internal threads 42 as the terminal 28 is inserted into the bore 36. As shown in FIG. 2, the starter thread median diameter 48 is defined as the distance between the midpoint of a thread on one side of the terminal 28 and the midpoint of a thread on the other side of the terminal 28 at a given axial point along the axis 50 and within the tapered body portion 52.

The terminal 28 also preferably includes a cylindrical body portion 54 having a generally cylindrical shape such that the engagement threads 46 have a generally constant engagement thread median diameter 56. The engagement thread median diameter 56 is defined as the distance between the midpoint of a thread on one side of the terminal 28 and the midpoint of a thread on the other side of the terminal 28 at a given axial point along the axis 50 and within the cylindrical body portion 54.

The terminal 28 may also preferably include a shoulder portion 58 having a shoulder diameter 59 greater than the diameter of the bore 36 in order to provide a hard-stop for the engagement between the terminal 28 and the bore 36. Additionally, the shoulder portion 58 provides a contact surface for the spring 29, as shown in FIG. 1. The spark plug 27 is preferably connected to the housing 18 via a non-conductive sleeve (not shown) that forms a press-fit connection with both the housing 18 and the spark plug 27. The non-conductive sleeve is preferably comprised of rubber. A chamfer portion 60 may be provided to more effectively form the seal 38 between the terminal 28 and the bore 36. The chamfer portion 60, if provided, is located between the engagement threads 46 and the shoulder portion 58, and preferably has a chamfer diameter 62 that increases in size from the cylindrical body portion 54 to the shoulder portion 58.

The terminal 28 may also include a head portion 64 located at the end of the terminal 28 opposite the connector portion 34. The head portion 64 may include a torque transfer member 66 in order to apply a torque to the terminal 28 and rotate the terminal 28 around the central axis 50 during installation. The torque transfer member 66 may have any appropriate configuration such as a hex nut **66*a*, a slotted screw member 66*b*, or an internal hex member 66*c***.

In another embodiment of the present invention, the terminal 28 does not include self-tapping threads, and the internal threads 42 of the housing 18 are formed before the terminal 28 is inserted within the housing 18. In this embodiment, the internal threads 42 may be formed by various means, such as a thread-tapping or thread-forming member other than the terminal 28. Alternatively, the internal threads 42 may be formed during the formation of the entire housing 18, such as during an injection molding process.

Referring now to FIG. 1, once the terminal 28 is inserted within the bore 36, the housing 18 may be filled with an encapsulate material 68. The encapsulate material 68 is preferably in a substantially liquid form when it is first inserted into the housing 18 in order to fully surround the components within the housing. The encapsulate material 68 then hardens in order to protect and to insulate the components within the housing 18.

Figure 4:
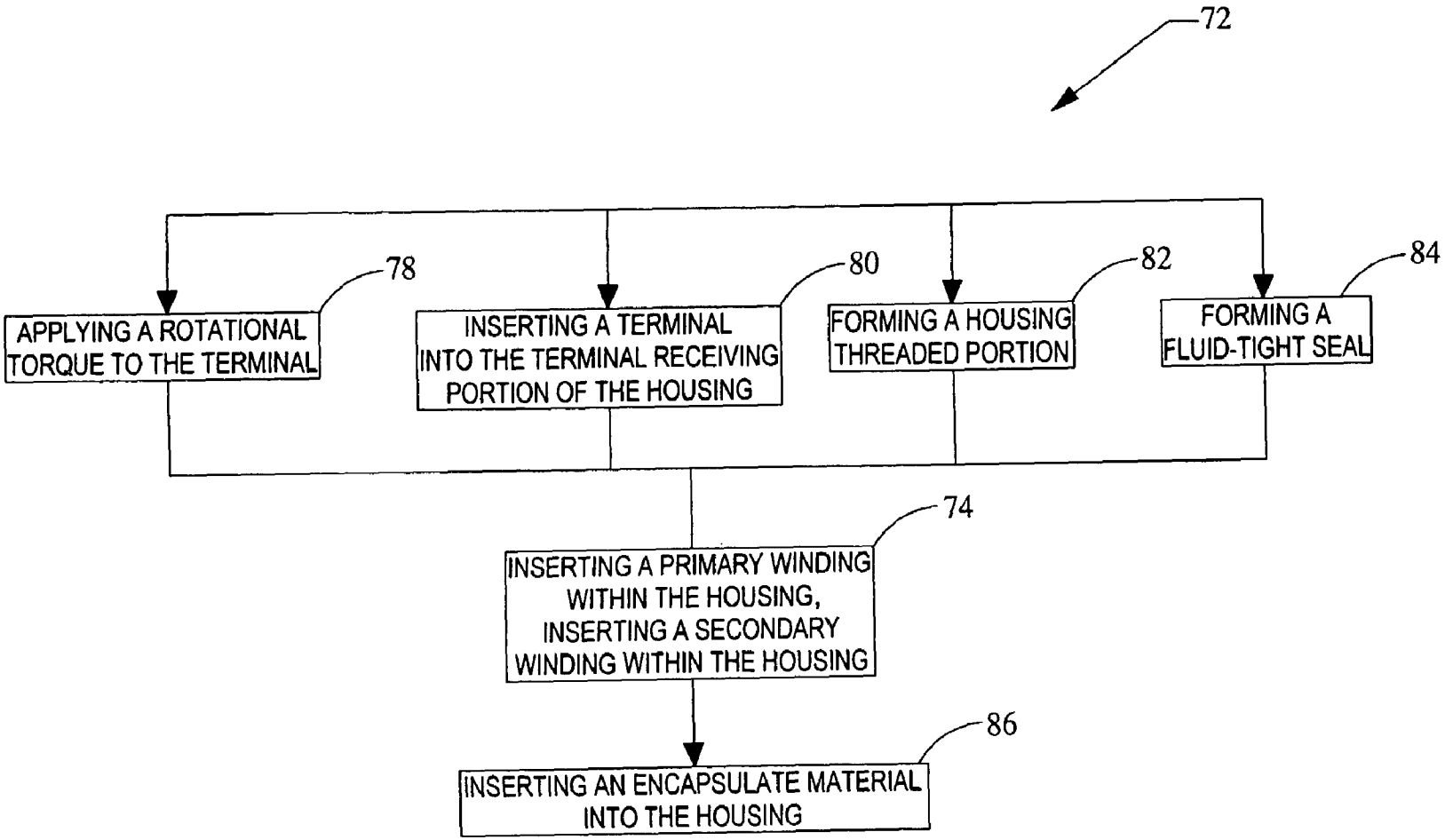
FIG. 4 is a flowchart of a method of manufacturing an ignition coil embodying the principles of the present invention.

Referring now to FIG. 4, a method of manufacturing an ignition coil 72 is provided. First, the steps of applying a rotational torque to the terminal 78, inserting a terminal into the terminal receiving portion of the housing 80, forming a housing threaded portion 82, and forming a fluid-tight seal 84 preferably occur substantially simultaneously. The second step is inserting a primary winding and a secondary winding within the housing 74. The next step is preferably inserting an encapsulate material into the housing 86 where it hardens.

It is therefore intended that the foregoing detailed description be regarded as illustrated rather than limiting, and that it be understood that it is the following claims, including all equivalents, that are intended to define the spirit and scope of this invention.

The invention claimed is:

1. A method of manufacturing an ignition coil including a housing having a terminal receiving portion, the method comprising the steps:

inserting a primary winding within the housing;

inserting a secondary winding within the housing;

inserting a terminal into the terminal receiving portion of the housing, wherein the terminal includes a terminal threaded portion; and forming a housing threaded portion within the terminal receiving portion of the housing with the terminal threaded portion;

wherein the step of inserting the terminal into the terminal receiving portion of the housing and the step of forming the housing threaded portion within the terminal receiving portion of the housing occur substantially simultaneously.

2. The method of manufacturing an ignition coil in claim 1, further comprising the step of forming a fluid-tight seal between the terminal and the terminal receiving portion of the housing.

3. The method of manufacturing an ignition coil in claim 1, further comprising the step of inserting an encapsulate material into the housing, wherein the terminal and the terminal receiving portion of the housing prevent the encapsulate material from exiting the housing via the terminal receiving portion of the housing.

4. The method of manufacturing an ignition coil in claim 1, wherein the terminal includes a torque transfer portion, wherein the method of manufacturing an ignition coil further comprises the step of applying a rotational torque to the torque transfer member of the terminal in order to rotate the terminal about an axis.

5. The method of manufacturing an ignition coil in claim 4, wherein the step of applying the rotational torque to the torque transfer member of the terminal and the step of forming the housing threaded portion within the terminal receiving portion of the housing occur substantially simultaneously.

6. The method of manufacturing an ignition coil in claim 5, wherein the torque transfer member is a slotted portion or a polygon-shaped portion.

* * * * *